US012612739B2

(12) United States Patent
Kuiper

(10) Patent No.: US 12,612,739 B2
(45) Date of Patent: Apr. 28, 2026

(54) METHOD FOR PRODUCING A MOULDED PULP MATERIAL FOR PACKAGING UNIT AND SUCH PACKAGING UNIT

(71) Applicant: Huhtamaki Molded Fiber Technology B.V., Leeuwarden (NL)

(72) Inventor: Harald John Kuiper, Leeuwarden (NL)

(73) Assignee: HUHTAMAKI MOLDED FIBER TECHNOLOGY B.V., Leeuwarden (NL)

( * ) Notice: Subject to any disclaimer, the term of this patent is extended or adjusted under 35 U.S.C. 154(b) by 413 days.

(21) Appl. No.: 17/786,857

(22) PCT Filed: Dec. 17, 2020

(86) PCT No.: PCT/NL2020/050802
§ 371 (c)(1),
(2) Date: Jun. 17, 2022

(87) PCT Pub. No.: WO2021/125957
PCT Pub. Date: Jun. 24, 2021

(65) Prior Publication Data

US 2023/0031748 A1 Feb. 2, 2023

(30) Foreign Application Priority Data

Dec. 20, 2019 (NL) ..... 2024533

(51) Int. Cl.
*D21J 3/00* (2006.01)
*B65D 65/46* (2006.01)
(Continued)

(52) U.S. Cl.
CPC ..... *D21J 3/00* (2013.01); *B65D 65/466* (2013.01); *D21J 7/00* (2013.01); *B65D 85/324* (2013.01)

(58) Field of Classification Search
CPC ..... D21J 3/00; D21J 7/00; D21J 3/10; D21J 5/00; D21H 17/20; D21H 17/28;
(Continued)

(56) References Cited

U.S. PATENT DOCUMENTS 4,377,440 A * 3/1983 Gasland ..... C04B 28/02 162/146
4,508,595 A * 4/1985 Gasland ..... D21H 23/26 162/158
(Continued)

FOREIGN PATENT DOCUMENTS

CN 111670282 B * 3/2023 ..... B65D 65/466
CN 118382521 A * 7/2024 ..... B29C 33/3814
(Continued)

*Primary Examiner* — Jose A Fortuna
(74) *Attorney, Agent, or Firm* — MH2 Technology Law Group, LLP

(57) ABSTRACT

A method for producing a moulded pulp material that is suitable for manufacturing of a packaging unit and such packaging unit. The method includes the steps of preparing a raw moulded pulp material, providing the raw moulded pulp material to an extruder, extruding the raw moulded pulp material, adding one or more additives, and providing the moulded pulp material at the outlet of the extruder.

15 Claims, 11 Drawing Sheets

(51) Int. Cl.
*D21J 7/00* (2006.01)
*B65D 85/32* (2006.01)

(58) Field of Classification Search
CPC ..... D21H 11/18; D21H 17/63; D21H 23/16; B65D 65/466; B65D 85/324; B65D 2565/383; B65D 65/38; B29C 43/02; B29C 45/0013; B29C 33/3842; B29C 43/36; B29C 49/04; B29C 48/05; B29C 67/202; B29C 67/243; B29C 70/025; B32B 13/02; B32B 27/04; B32B 27/20; B32B 37/144; B32B 2305/30; B32B 2439/70; B32B 2317/20; B32B 7/90; Y02W 90/10
See application file for complete search history.

(56) References Cited

U.S. PATENT DOCUMENTS 5,783,126 A * 7/1998 Andersen ..... C04B 41/61 264/102
5,830,305 A * 11/1998 Andersen ..... B05B 1/34 264/102
5,849,152 A * 12/1998 Arnold ..... C08L 3/02 162/149
5,849,155 A * 12/1998 Gasland ..... C08L 3/02 162/158
6,180,037 B1 * 1/2001 Andersen ..... B29C 51/002 264/108
6,436,237 B1 * 8/2002 Berckmans ..... D21H 17/29 162/175
6,468,133 B1 * 10/2002 Dettling ..... D21H 25/005 451/28
6,475,601 B1 * 11/2002 Sakaki ..... D21H 21/52 428/32.3
6,878,199 B2 * 4/2005 Bowden ..... C08L 97/02 264/300
10,619,303 B2 * 4/2020 Thole ..... D21H 11/16
12,071,727 B2 * 8/2024 Chung ..... D21H 17/56
2003/0177915 A1 * 9/2003 Kaki ..... D21H 17/29 99/485
2004/0244929 A1 12/2004 Henke et al.
2006/0159871 A1 * 7/2006 Agrawal ..... D21H 17/45 162/100
2007/0066722 A1 3/2007 O'Neill et al.
2019/0055696 A1 * 2/2019 Rao ..... D21H 17/29
2021/0164171 A1 * 6/2021 Kuiper ..... B65D 65/466
2022/0288888 A1 * 9/2022 Appleford ..... B32B 29/005
2022/0325078 A1 * 10/2022 Tiefenbacher ..... C08L 99/00
2023/0031748 A1 * 2/2023 Kuiper ..... D21J 3/00
2023/0295881 A1 * 9/2023 Phipps ..... B65D 1/00 162/223
2023/0364831 A1 * 11/2023 Goldberg ..... B29C 33/3814
2024/0286813 A1 * 8/2024 Ashton ..... B65D 65/466
2025/0027015 A1 * 1/2025 Bell ..... B65D 65/46

FOREIGN PATENT DOCUMENTS

DE 2920988 C2 * 8/1991 ..... D21J 3/00
EP 4214362 B1 * 10/2024 ..... D21J 7/00
GB 2050459 A * 1/1981 ..... B29C 47/0004
NL 2024533 B1 * 9/2021 ..... B65D 65/466
RU 2819018 C2 * 5/2024 ..... C08J 11/02
SE 544591 C2 * 9/2022 ..... B65D 65/38
WO WO-2007098635 A1 * 9/2007 ..... D21J 3/00
WO WO-2010149711 A2 * 12/2010 ..... D21B 1/12
WO 2018067006 4/2018
WO 2019112428 6/2019
WO WO-2019112428 A1 * 6/2019 ..... B65D 65/466
WO WO-2021125957 A1 * 6/2021 ..... B65D 65/466

* cited by examiner

METHOD FOR PRODUCING A MOULDED PULP MATERIAL FOR PACKAGING UNIT AND SUCH PACKAGING UNIT

BACKGROUND

Field of the Technology

The present invention relates to a method for producing a moulded pulp material that is suitable for manufacturing a (3-dimensional) moulded packaging unit. Such packaging units may relate to cases, boxes, cups, plates, carriers, meal boxes, sip lids etc.

Description of the Prior Art

Packaging units that are made from a moulded pulp material are known. These packaging units require a raw moulded pulp material that originates from recycled paper material and/or virgin fibers. These packaging units are used to store, transport and/or display a range of products, including food products such as eggs, tomatoes, kiwis, and also other products like bottles, meals, and even liquids.

Conventional packaging units require a substantial amount of (raw) material and therefore weight to assure sufficient strength for the packaging units to carry or hold the products. The requirements for sufficient strength are even increased when packaging units are stacked during storage, transport and/or display in shops, for example. To increase the strength of the packaging units to fulfil the strength requirements, more material is used in these conventional packaging units. This requires more material and involves higher costs. These costs are even further increased as the use of more material also involves more drying costs associated with the moulded pulp material.

BRIEF SUMMARY

The present invention has for its object to obviate or at least reduce the above stated problems with conventional moulded pulp packaging units and to provide a moulded pulp material that can be used to manufacture packaging units that have a high strength-weight ratio.

For this purpose the present invention provides a method for producing moulded pulp material for packaging units, the method according to the invention comprising the steps of:

- preparing a raw moulded pulp material;
- providing the raw moulded pulp material to an extruder;
- extruding the raw moulded pulp material;
- adding one or more additives; and
- providing the moulded pulp material at the outlet of the extruder.

The 3-dimensional packaging unit that is manufactured from the moulded pulp that is produced according to the invention comprises a compartment capable of carrying or receiving a product, such as a food product. For example, a food receiving compartment may relate to a compartment capable of holding a food product, such as eggs, tomatoes, kiwis, or a container for holding a liquid or beverage. A carrying compartment may relate to a carrier surface whereon or wherein a food product can be placed, such as a plate, cup, bowl, bottle divider etc. In other embodiments according to the invention, the food receiving compartment is capable of receiving and holding a meal, for example ready-to-eat meals, salads etc.

According to the invention the raw material is provided to an extruder that performs an extrusion process on the raw moulded pulp material. The extrusion process "opens" the fibers and enables a higher degree of fibrillation of the fibers. In addition, in a presently preferred embodiment the fiber length in the moulded pulp material comprises that is the result of the extrusion process is higher as compared to conventional final lengths in moulded pulp material. Experiments showed a significant fiber length increase of about 60%. Experiments have shown that this higher fiber length renders dewatering of the end product easier such that a higher production capacity can be achieved. This reduces drying costs and increases production capacity such that packaging units can be manufactured more cost effectively.

The moulded pulp material that results after the extrusion process according to the method of the invention achieves a higher strength as compared to conventional moulded pulp materials. Experiments showed an increase of the strength with a factor of 2-3 for 3-dimensional products with similar amounts of material, more specifically the same weight. Therefore, the strength-weight ratio is also increased by the factor 2-3 or even more. It will be understood that also a weight reduction can be envisaged while maintaining the same strength-weight ratio. Also in such case the strength-weight ratio increases.

The raw moulded pulp material comprises material from recycled paper, virgin soft wood material, virgin hard wood material and/or other sources. Optionally, the raw moulded pulp material is pretreated. Such pretreatment may involve kneeding, mixing and/or shreddering. After extrusion the resulting moulded pulp material is used for the manufacturing of a packaging unit that can be used for applications mentioned earlier.

In a presently preferred embodiment the method further comprises the step of adding a pigment as one of the additives.

By adding a pigment into the moulded pulp material a coloured moulded pulp material is achieved. The pigment is preferably added during the extrusion process. Adding the pigment during the extrusion process enables thorough mixing of the pigment in the material. This provides a homogeneous distribution of the pigment over the moulded pulp material. In one of the presently preferred embodiments of the invention anionic pigments were applied and added as an additive. Preferably, the anionic pigments comprise isothiazol and glutaral as base compounds commercialized with the trademark of Irgalite® from Solenis. Specific pigments used were Irgalite® Yellow Oxide M-E, Irgalite® Blue R-LW, Irgalite® Red G-L and the mixture of blue and yellow to produce the green color. It will be understood that other pigments can be used as an alterantive or in combination. For example, the dispersed anionic pigments with the trademark Cartaren CNG 500 can be applied, Preferably, natural biodegradable pigments are being used. Furthermore, other additives such as dye stuffs, AKD as a binder, or other additives can be added.

In the extrusion process fibers of the raw moulded pulp material are "opened" to a higher extent as compared to conventional methods with pulping and refining for providing moulded pulp material. This enables an improved fixation of the pigment to the fiber material. Therefore, the adding of a pigment during the extrusion process improves the colouring of packaging units. This may assist in providing visual indications of the content of the packaging unit to a consumer. For example, a green colour can be used for at Italian food products that are held in the packaging units. In addition to providing a visual indication this improved colouring may also result in a reduction of packaging material as sleeves or labels as their use can be reduced or even completely omitted from the packaging unit.

Surprisingly, pigments showed a higher binding when being added in the extrusion process. This substantially reduces the amount of pigments/colouring components in the process water, thereby resulting in cleaner process water such that less energy is required for cleaning. Also, this improved binding of the pigments assists in the reduction of the footprint of the packaging units that are manufactured with the use of moulded material that is provided by the method of the invention.

Optionally, a colouring agent/pigment is added to the moulded pulp as a soluble dye. These agents can be cationic or anionic and are in another classification also referred to as basic dyes, direct dyes or acid dyes. In a presently preferred embodiment cationic colouring agents are used. Optionally, the moulded pulp material can be coloured using additives, dyes (basic dyes, direct dyes, anionic and/or cationic charged dyes), pigments or other components that provide colour to the packaging unit. This enables providing the packaging unit with a colour representative for its (intended) contents. The increase in fiber length contributes to the binding of pigments to the fibers in the extrusion process.

As a further effect, the improved binding of the pigments to the fibers also reduces the colouring components that stay behind in manufacturing equipment. This is relevant, especially when changing product type or product colour, as it reduces the amount of cleaning, thereby further reducing the amount of wastewater. In addition, the change of a product or product type on the manufacturing equipment can be performed more easily and faster, such that the manufacturing process of the packaging unit is more flexible.

Optionally, the pigment is added in the extrusion process in combination with adding a so-called fixative. These fixatives provide a better fixation of the pigment to the fibers. This further enhances the aforementioned advantages of adding a pigment in the extrusion process. The pigment(s) and fixative(s) can be supplied separately or in combination. For example, the fixative can be supplied before adding the pigment, or vice versa.

Experiments showed an improved and accurate fixation of the pigment to the pulp fiber with the use of selecting a cationic fixative comprising one or more dimethylamine polymers (CatiofastTM 159 from Solenis). The weight ratio of pigment to fixative is preferably selected in the range of 2-25, more preferably 3-20, and most preferably 4-19. Therefore, the amount of fixative is limited and much lower as the pigment weight. It will be understood that the use of other fixative can also be envisaged, for example a combination of a dispersed anionic pigment, with the trademark Cartaren CNG 500, and the aforementioned cationic fixative Cartafix was used in experiments. Preferably, after adding a fixative a pigment or colorant is added.

In experiments fibers are wettened in a tank or mixing tank prior to feeding into a (twin screw) extruder, wherein the fibers are preferably anionically charged (negative charge). The fixative is added directly after disclosing and refining the fibers in the (twin screw) extrusion process. In fact, in a presently preferred embodiment in the same extrusion process, at the same twin screw in a different zone, you add the cationic (positive charged) fixative first to react with the anionic cellulose fibers, then 1-2 zones later on the twin screw line, or further downstream the twin screw process, to be sure reaction is completed, the presently preferred anionic dyestuff or pigment is added. The fixative is working as the bridging molecule to attach the pigment or dyestuff molecule in such a way that the fixation is strong, avoiding colour bleed into water systems. By doing this the colorant is fixed to the fibers and the coloured pulp can be used to produce coloured products on an in-mould drying machine (IMD) to manufacture coloured smooth molded fiber products. This obviates the negative effects of colour bleed into the water system of the moulding machine which would cause a lot of negative effects for the machine (dirty coloured off-set) and the need to treat the water before it can be re-used for a next production run.

A further advantage of a method according to the invention is that that quick colour changes on the moulding machine are possible to make coloured products without the disadvantages of needing a pulper, refiner, water treatment devices like a DAF (dissolved air flotation) in combination with a carbon filter or similar treatment system, which avoids a lot of investment. Therefore, the method according to the invention provides an efficient and effective process for producing a moulded pulp material. In a preferred embodiment of the invention the raw moulded pulp material comprises a mixture of softwood and hardwood.

Providing a mixture of soft wood and hard wood provides an effective moulded pulp material with optimum properties for the resulting packaging units that are produced from this moulded material. Hard wood relates to birch, for example. Soft wood relates to spruce and pine trees, for example. The mixture of hard wood versus soft wood is preferably in the range of 80-20 to 20-80 weight percent, more preferably in the range of 70-30 to 30-70, and most preferably in the range of 60-40 to 40-60 weight percent. It will be understood that also the addition of other materials can be envisaged in accordance to a method of the invention.

In a further preferred embodiment the mixture comprises an amount of a biodegradable aliphatic polyester.

In a presently preferred embodiment of the invention the biodegradable aliphatic polyester preferably comprises an amount of one or more of PHB, PHA, PCL, PGA, PBS, PHBH, and PHBV. It is shown that these components effectively reduce the surface roughness of the final packaging unit. In presently preferred embodiments the weight percentage of one or more of the aforementioned components is in the range of 0.5-20%, more preferably in the range of 1-15%. In addition to, or as an alternative, an amount of PET and/or RPET is added to the moulded pulp, preferably in a similar range. Preferably, the amount of biodegradable aliphatic polyester is between 2 and 10 wt %, preferably between 5 and 9 wt %, and is most preferably in the range of 6.5 to 8 wt %.

Applying an amount of biodegradable aliphatic polyester in these ranges provides packaging units that are both stable and strong. Another advantage when using a biodegradable aliphatic polyester in a food packaging unit is the constancy of size or dimensional stability. As a further advantage of the use of a biodegradable aliphatic polyester, the so-called heat seal ability of the packaging unit is improved. This further improves (food) packaging characteristics.

An even further advantage of introducing an amount of a biodegradable aliphatic polyester in a food packaging unit is that the properties of the packaging unit can be adjusted by mixing or blending the main biodegradable aliphatic polyester with other polymers or agents. Also, it is possible to prepare the biodegradable aliphatic polyester material for (paper) coating and printing. Furthermore, in some embodiments, digital printing may be applied to the laminated trays to reduce the total cost of the packaging unit. This further improves the sustainability of the packaging unit. Also, a paper look may be achieved.

In a further preferred embodiment of the invention the packaging unit that is manufactured from the moulded pulp produced by the method of the invention is biocompostable.

In the context of this invention degradable relates to degradation resulting in loss of properties, while biodegradable relates to degradation resulting from the action of microorganisms such as bacteria, fungi and algae. Compostable relates to degradation by biological process to yield $CO_2$, water, inorganic compounds and biomass.

In a presently preferred embodiment the resulting packaging unit according to the invention is biodegradable and preferably biocompostable as a whole. More preferably, the unit is biodegradable at a temperature in the range of 5 to 60° C., preferably in the range of 5-40° C., more preferably in the range of 10-30° C., even more preferably in the range of 15-25° C., and most preferably at a temperature of about 20° C. This renders decomposing of the packaging unit easier. Furthermore, this enables so-called ambient or at home decomposing of the packaging unit according to the invention. For example, the packaging unit according to the invention may be industrial and/or home compostable according to EN 13432.

Tests with a packaging unit in an embodiment of the invention showed a home compostability wherein the packaging unit decomposed within 24 weeks in accordance with the accepted practical standard.

The packaging unit that is the end-product of the moulded pulp material produced by a method of the invention is preferably compostable thereby improving the sustainable character of the packaging unit. This provides a biodegradable alternative material to plastics, for example. This improves recycling properties of the packaging units that are made from moulded pulp (including so-called virgin fiber material and/or recycled fiber material) and that optionally comprise a biodegradable aliphatic polyester.

A further advantage of adding an amount of biodegradable aliphatic polyester is that the packaging unit can also be decomposed using microorganisms in soil, for example. This enables decomposing the packaging unit comprising a biodegradable aliphatic polyester as a whole. In such preferred embodiment, the packaging unit can even be decomposed at home, thereby rendering the packaging unit home-compostable. Such home-compostable tray further improves the overall sustainability and enables replacing the use of less sustainable materials, such as PP, PE, PS.

The biodegradable aliphatic polyester can be mixed in the original moulded pulp material in the extrusion process such that it is distributed over substantially the entire packaging unit and/or can be provided as a separate layer on the side of the packaging unit that may come into contact with food products, for example.

A further advantage of adding an amount of a biodegradable aliphatic polyester is the improvement of barrier properties. Water barrier properties can be improved to reduce the penetration of water into the packaging unit and thereby reducing ridging problems and/or loss of strength and stability during use, for example. Another advantage when using a biodegradable aliphatic polyester in a packaging unit is the improved constancy of size or dimensional stability.

Preferably, the use of biodegradable aliphatic polyester is combined with the use of further additives or substances that aim at improving or achieving specific properties of the packaging unit. In further presently preferred embodiments the bio-polymers that are applied originate from so-called non-gmo (non-genetically modified organisms) biopolymers. For example, it was shown that the use of one or more biodegradable aliphatic polyesters may improve the strength and stability of the packaging unit, thereby providing a stronger packaging unit and/or requiring less raw material.

According to one of the preferred embodiments of the invention the biodegradable aliphatic polyester comprises an amount of PHBH. Experiments showed an improved temperature behaviour improving manufacturing possibilities by providing an acceptable behaviour up to 200° C. and even up to 220° C.

According to one of the alternatively preferred embodiments of the invention the biodegradable aliphatic polyester comprises an amount of polybutylene succinate (PBS). PBS is one of the biodegradable aliphatic polyesters. PBS can also be referred to as polytetramethylene succinate. PBS decomposes naturally into water, $CO_2$ and biomass. The use of PBS as a compostable material contributes to providing a sustainable product.

The use of PBS is possible in food-contact applications including food packaging units from a moulded pulp material. An advantage of the use of PBS is that the decomposition rate of PBS is much higher as compared to other agents or components such as PLLA (including variations thereof such as PDLA and PLDLLA, for example).

Therefore, the use of PBS in a packaging unit from moulded pulp significantly improves the sustainability of the packaging unit. This improves recycling possibilities and biodegrading or decomposing the packaging unit. For example, the use of PBS in lid seals may obviate the need for non compostable PE as inner liner.

In a further embodiment of the present invention the method involves the use of an amount of natural and/or alternative fibers in the raw moulded pulp material. This material is preferably processed in the extrusion step and optionally thoroughly mixed with other materials, such as the hard wood fibers, soft wood fibers, fixatives and pigments.

Providing an amount of natural and/or alternative fibers provides a natural feel to the packaging unit and/or improves the overall strength and stability of the packaging unit. Such natural/alternative fibers may comprise fibers from different origin, specifically biomass fibers from plant origin. This biomass of plant origin may involve plants from the order of Poales including grass, sugar cane, bamboo and cereals including barley and rice. Other examples of biomass of plant origin are plants of the order Solanales including tomato plants of which the leaves and/or stems could be used, for example plants from the Order Arecales including palm oil plants of which leaves could be used, for example plants from the Order Maphighiales including flax, plants from the Order of Rosales including hemp and ramie, plants from the Order of Malvales including cotton, kenaf and jute. Alternatively, or in addition, biomass of plant origin involves so-called herbaceous plants including, besides grass type plants and some of the aforementioned plants, also jute, Musa including banana, Amarantha, hemp, *cannabis* etcetera. In addition or as an alternative, biomass material origination from peat and/or moss can be applied.

Preferably, the (lignocellulosic) biomass of plant origin comprises biomass originating from plants of the Family of Poaceae (to which is also referred to as Gramineae). This family includes grass type of plants including grass and barley, maize, rice, wheat, oats, rye, reed grass, bamboo, sugar cane (of which residue from the sugar processing can be used that is also referred to as bagasse), maize (corn), sorghum, rape seed, other cereals, etc. Especially the use of so-called nature grass provides good results when manufacturing packaging units such as egg packages. Such nature grass may originate from a natural landscape, for example.

This family of plants has shown good manufacturing possibilities in combination with providing a sustainable product to the consumer.

Preferably, the method further comprises the step of moulding a 3-dimensional packaging unit from the moulded pulp material that is produced in the extrusion process. Such packaging units can be used as a bottle divider, ready-to-eat meal packaging unit, egg container, meat container, cup, sip lids, and other suitable food carrying product.

In a further preferred embodiment of the invention the method further comprises the step of:

providing a laminated multi-layer comprising:

an inner cover layer comprising an amount of a biodegradable aliphatic polyester;

a first intermediate layer of a biodegradable material for connecting and/or sealing adjacent layers;

a functional layer comprising a vinyl alcohol polymer;

a second intermediate layer of a biodegradable material for connecting and/or sealing adjacent layers; and an outer cover layer comprising an amount of a biodegradable aliphatic polyester, manufacturing the packaging unit with the laminated multi-layer to provide a packaging unit that is a compostable packaging unit.

According to an embodiment of the invention the 3-dimensional packaging unit comprises a biodegradable laminated multi-layer. This laminated multi-layer is in some of the presently preferred embodiments of the invention provided on or at a food contact surface of the food receiving and/or carrying compartment. In some other embodiments of the invention the laminated multi-layer is provided in the moulded pulp material of the food receiving and/or carrying compartment.

The combination of providing a moulded pulp involving an extrusion process and providing a laminated layer on the final end-product is the combination of high strength and good barrier properties. The improved strength reduces bending and twisting of the packaging unit during uses, thereby reducing the risk of damaging the laminated layer with the barrier properties. According to the present invention the laminated multi-layer comprises at least 5 material layers. It will be understood that additional layers can also be provided in accordance to the present invention. The inner and outer cover layer comprise an amount of a biodegradable aliphatic polyester, such as PBS, PHB, PHA, PCL, PGA, PHBH and PHBV. The inner and outer cover layer may also comprise a biodegradable composition of materials, such as a combination of starch and one of the aforementioned biodegradable aliphatic polyesters, such as PBS. This improves the surface properties of the laminated multi-layer, and the packaging unit provided therewith. This includes the so-called wipeability of the packaging unit. Wipeability relates to the possibility to remove stains from the surface and reducing or even preventing penetration into the material. Also, it may provide more possibilities for masking (hiding) undesirable stains and/or promoting the compostable effect of the packaging unit. The surface properties also relate to grease resistance such that the (chemical properties) of the packaging unit can be remained during its use, for example. Also, the penetration of oil originating from the food product, such as pasta or French fries, into the food packaging unit can be reduced. Also, water barrier properties can be improved to reduce the penetration of water into the packaging unit and thereby reducing ridging problems, for example.

In addition, the laminated multi-layer comprises a functional central layer comprises a biodegradable and compostable vinyl alcohol polymer. This function layer contributes to the multi-layer properties, such as acting as a gas barrier. For example, the functional layer may provide an effective O2 barrier. This improves shelf-file of the food product(s) in the packaging unit. In a presently preferred embodiment the vinyl alcohol polymer comprises a highly amorphous vinyl alcohol polymer, such as HAVOH, and/or butandiol vinyl alcohol co-polymer (BVOH). Such polymer or polymer mixture also provides an effective barrier, especially a gas barrier, and more specifically an oxygen barrier. Such barrier can effectively be used to further improve the shelf-life of the food product(s). In addition, this also reduces food waste, thereby further improving the sustainable effects of the food packaging unit according to the present invention. Experiments showed a surprisingly effective O2 barrier, especially at relative humidities up to 60% as compared to conventional materials. An example of BVOH is G-Polymer.

As a further advantage, vinyl alcohol polymers are mouldable and extrudable. This renders it possible to co-extrude the laminated multi-layer with the basic material of the packaging unit, especially the basic material of the compartment(s), such as the moulded pulp material. The co-extruded material can be moulded or deepdrawn. This provides efficient and effective manufacturing processes for the packaging unit of the present invention. The efficiency can even be improved further by recycling the remainders after punching the material into the manufacturing process.

The inner and outer cover layers are separated from the central functional layer by an intermediate layer, to which can also be referred to as a tie layer. Such intermediate layer is substantially of a biodegradable material and connects and/or seals its adjacent layers. Preferably, the intermediate layers improve or at least contribute to maintaining the desired properties of the central functional layer, such as acting as a gas barrier. For example, the intermediate layers seal the central functional layer against liquid penetration to maintain the gas barrier properties of the functional layer.

It will be understood that additional separate layers can be provided in the laminated multi-layer, providing 7, 9 or 11 layers of material improving the overall properties of the laminated multi-layer, for example including grease barrier and odour barrier.

It was shown that by applying a laminated multi-layer the overall properties of the packaging unit were improved. In fact, the packaging unit with a laminated multi-layer enables the compartment to hold different kinds of food, including ready meals with pasta sauce for example.

The combination of the barrier properties and the wipeability of the laminated multi-layer in a packaging unit according to the invention enables the use of these packaging units for a wide range of food products, including meat packaging, for example. In fact, the packaging unit of the invention substantially prevents stains in the product caused by hemoglobin contained in the meat. This improves the visual appearance of the product and the shelf-life of the product.

Furthermore, the packaging unit according to the present invention is compostable. This reduces waste and provides a more sustainable packaging of food products.

According to the present invention the packaging unit with the food receiving and/or carrying compartment is manufactured from a moulded pulp material. In a presently preferred embodiment the laminated multi-layer is co-extruded with the moulded pulp material and thereafter deep-drawn into the desired shape of the packaging unit. In another presently preferred embodiment the laminated multi-layer is provided in an in-mould operation, preferably in combination with an in-mould drying operation. As a further alternative the laminated multi-layer is laminated on the moulded pulp material, optionally comprising one or more of: deepdrawing with underpressure/vacuum, heating, providing overpressure at the top side. The multi-layer according to the invention showed effective capabilities of being deep-drawn in the packaging unit.

As a further advantage, the packing unit with the laminated multi-layer renders it possible to provide the packing unit with a paper look and paper feel. This improves consumer perceptance of the packing unit.

An even further advantage when applying a laminated multi-layer is the insulating effect that is provided to the (food) packaging unit. This is especially relevant in case of instant meals that are heated in a magnetron, for example conventional packaging units heat up to a temperature of 90-100° C. with the similar packaging unit that is provided with a laminated multi-layer heating up to 50-70° C. This improves the safety of using such meals. Experiments showed that it was possible to achieve a temperature resistance of the packing units up to 200° C. and even up to 220° C. This improves the so-called "cool-to-touch" characteristic of the packaging unit. This prevents a consumer from being injured when removing a packaging unit from the oven. More specifically, "cool-to-touch" relates to an outside packaging temperature in the range of 10-30° C. after heating the product in an oven, for example. This is a lower temperature as compared to conventional CPET packaging units, for example. Therefore, the packaging unit according to the invention is more safe in use.

As an even further advantage, the packaging unit with the laminated multi-layer maintains the biodegradability and/or compostable properties of the packaging unit as it obviates the need for the use of fluorochemicals as is required in conventional packaging units, for example in the production of disposable tableware. The production of disposable tableware is for example the production of Chinet disposable tableware. Therefore, the packaging unit according to the present invention improves the sustainability of handling food products. In fact, this enables decomposing the food packaging unit as a whole. In such preferred embodiment, the food packaging unit can be decomposed at home, thereby rendering the food packaging unit home-compostable. Such home-compostable packaging unit further improves the overall sustainability of the packaging unit of the invention. This enables replacing the use of less sustainable materials, such as CPET, PP, PE, PS, aluminium in food packaging units.

The food packaging unit according to the invention is preferably compostable thereby providing a sustainable packaging unit. This provides a biodegradable alternative material to conventionally used plastics, for example. This improves recycling properties of the packaging units that are made from moulded pulp (including so-called virgin fiber material and/or recycled fiber material) and comprise a biodegradable laminated multi-layer. In several of the presently preferred embodiments of the invention the packaging unit is also marine degradable, thereby further improving the sustainability of the packaging unit.

A further advantage of providing a packaging unit with the multi-layer according to the present invention is the possibility to apply modified atmosphere conditions in the packaging unit. The barrier properties preferably act in both directions, from outside to the inside, and from the inside to the outside. This enables so-called MAP-products that may further improve shelf-life, for example.

In a presently preferred embodiment the laminated multi-layer is a co-extruded laminated multi-layer. Co-extrusion enables constructing a layer comprising multiple sub-layers by melting, extruding and joining the separate layers. In a presently preferred embodiment the laminated multi-layer is melted or fused with the compartment that receives and/or holds the food. Preferably, the laminated multi-layer is provided on a food contact surface of the compartment to improve shelf-life of the food.

In a presently preferred embodiment the packaging unit comprises a layer of biodegradable aliphatic polyester on a food contact surface to improve melting and/or fusing of the laminated multi-layer thereon. This provides a good connection between the compartment and the laminated multi-layer and also maintains the compostability properties of the packaging unit according to the invention. Actually, such optional layer of biodegradable material functions as binder for the connection between the laminated multi-layer and the packaging unit. This also improves the strength and stability of the laminated multi-layer and the packaging unit as a whole. The thickness of this thin layer is preferably in the range of 1 to 100 μm.

Alternatively, or in addition thereto, the laminated multi-layer is melted and protrudes into and/or is integrated in the moulded pulp material matrix. This provides the material matrix of the packaging unit with the desired properties.

By providing a heating step the melting and/or fusing of the laminated multi-layer to the biodegradable aliphatic polyester fibers in the moulded pulp material is further improved. In fact, the heating step improves the adherence/connection of the laminated multi-layer to the packaging unit. This heating step can be performed in a press that pushes the laminated multi-layer into the correct shape onto the food contact surface. Alternatively, in one of the presently preferred embodiments of the invention, the laminated multi-layer is provided inside the mould wherein the package unit is manufactured from the moulded pulp material. The laminated multi-layer is provided in the mould onto the packaging unit. The food packaging unit with the laminated multi-layer can be dried in the mould involving a so-called in-mould drying operation or can alternatively be dried in an additional separate drying step after releasing the product from the mould.

Optionally, the laminated multi-layer is provided applying pre-stress to the laminated multi-layer. In another embodiment, to reduce the risk of providing a laminated multi-layer with reduced thickness in the corners of the packaging unit, the laminated multi-layer is designed and shaped according to the desired dimensions and thereafter provided to the packaging unit. This may involve cutting the design of the laminated multi-layer and folding it onto the food contact surface. Thereafter, in one of the presently preferred embodiments, the heating step is performed to melt or fuse the materials together.

In one of the presently preferred embodiments of the invention the thickness of the individual layers is within the range of 1.5-50 μm, preferably in the range of 1.5-30 μm, and wherein the total thickness of the laminated multi-layer is in the range of 20-150 μm. These layers provide a laminated multi-layer having an acceptable thickness and providing effective barrier properties, for example.

In one of the presently preferred embodiments of the invention the functional layer has a thickness in the range of 1.5-10 μm and is most preferably in the range of 3-5 μm. The intermediate layers have a thickness that is preferably also in the range of 1.5-10 μm and most preferably in the range 1.5-3 μm for an individual layer. The inner and outer cover layer have a thickness that is preferably in the range of 20-50 μm, more preferably in the range of 20-40 μm. It will be understood that different combinations of layers and thicknesses can be made. It is presently preferred to have a total thickness of the biodegradable multi-layer in the range of 23-70 μm, more preferably in the range of 30-60 μm, even more preferably in the range of 30-50 μm, and most preferably a thickness of about 40 μm.

In a further presently preferred embodiment the functional layer has a thickness in the range of 1.5-10 μm and is most preferably in the range of 3-5 μm. The intermediate layers have a thickness that is preferably also in the range of 1.5-10 μm and most preferably in the range 1.5-3 μm for an individual layer. The inner and outer cover layer have a thickness that is preferably in the range of 20-50 μm, more preferably in the range of 30-40 μm. It will be understood that different combinations of layers and thicknesses can be made. It is presently preferred to have a total thickness of the biodegradable multi-layer in the range of 70-100 μm, more preferably in the range of 70-90 μm, and most preferably a thickness of about 80 μm. Experiments have shown an effective barrier, especially an oxygen barrier, having a lower weight that can be applied cost effectively. In embodiments of packaging units with a top seal film, this top seal film is preferably provided with a similar multi-layer construction and a thickness in the range of 25-100 μm, more preferably in the range of 30-50 μm. The thickness of the intermediate and functional layers is preferably similar to the multi-layer, while the inner and outer cover layers are provided with a reduced thickness. In a number of applications the reduced thickness of the top seal film as compared to the laminated multi-layer is possible because the top seal film does not need to be deep-drawn in the manufacturing process.

According to a preferred embodiment of the invention the packaging unit may comprise a biodegradable top seal film. Providing such biodegradable top seal film provides a fully biodegradable and compostable packaging unit for food products. This enhances disposal possibilities for the material, thereby obviating the risk of mixed waste streams. Furthermore, it reduces the amount of residual waste. This significantly improves the sustainability of the food packaging industry.

Preferably, the packaging unit is provided with a circumferential edge comprising a connecting surface for the top seal film that is substantially free of the laminated multi-layer.

Such edge or alternative connecting surface enables the adherence of the top seal film to the compartments of the packaging unit. In some embodiments packaging units are provided with a (transparent) seal, foil, film, sheet or liner closing the opening of the packaging unit. In fact, this layer acts as a closure to the packaging unit. The use of a biodegradable aliphatic polyester such as PBS in packaging units contributes to the adherence of this closure to the packaging unit. In fact the biodegradable aliphatic polyester (partly) acts as an adhesive or glue.

It was shown that this contributes to the hot seal peelability, i.e. removing the transparent layer after the packaging unit is heated in a microwave for example, and/or to the cold seal peelability, i.e. removing the transparent layer when taking the packaging unit from the fridge and before heating for example.

Optionally, a thin layer of biodegradable aliphatic polyester is provided to adhere the transparent layer to the edge of the packaging unit. Preferably, the transparent layer is also home compostable. In a presently preferred embodiment the transparent layer comprises an amount or mixture of PBS and/or PHBT. Optionally, a thin anti-fog layer is provided to improve the transparency of the layer. Also optionally, the transparent layer comprises an amount of PVOH to improve the performance in relation to the O2-permeability. This can advantageously be applied to packaging units for meat and meat products, for example.

In a presently preferred embodiment of the invention the top seal film also comprises one or more biodegradable aliphatic polyesters. This may improve the adherence of the top seal film to the laminated multi-layer and/or to the moulded pulp material. Optionally, a separate adherence layer is provided.

In a further preferred embodiment of the invention the laminated multi-layer comprises a colouring agent. By providing a colouring agent the visual appearance of the packaging unit of the invention can be improved. Furthermore, this can be used to provide a consumer with additional information as was mentioned in relation to adding a pigment in the extrusion process to provide a moulded pulp for manufacturing a packaging unit. For example, Indian meals can be provided in a red coloured packaging unit and Italian food can be provided in a green coloured packaging unit. It will be understood that these examples can be extended to other exchanges of information with a consumer. Preferably, the colouring agent is biodegradable and more preferably compostable. This maintains the packaging unit as a whole being biodegradable or even compostable.

The present invention also relates to a packaging unit that is manufactured from moulded pulp material produced by the method of the present invention.

Such packaging unit provides the same effects and advantages as described in relation to the method.

In a presently preferred embodiment the moulded pulp material comprises an amount of fibers, wherein at least 80 percent of the fibers has a length above 1.1 mm, preferably above 1.2 mm. This provides a significant length increase of the fibers that are provided in the moulded pulp material. This results in an increased strength-weight ratio for the final packaging units. Preferably, the packaging unit is provided with a pigment, more preferably a biodegradable pigment, and even more preferably a compostable pigment. In addition, the packaging unit can be provided with natural fibers as is explained earlier in relation to method. Furthermore, in the presently preferred embodiment the packaging unit is provided with a biodegradable laminated multi-layer, with the multi-layer comprising:

- an inner cover layer comprising an amount of a biodegradable aliphatic polyester;
- a first intermediate layer of a biodegradable material for connecting and/or sealing adjacent layers;
- a functional layer comprising a vinyl alcohol polymer;
- a second intermediate layer of a biodegradable material for connecting and/or sealing adjacent layers; and
- an outer cover layer comprising an amount of a biodegradable aliphatic polyester, and
- wherein the food packaging unit is a compostable food packaging unit,
- wherein the thickness of the individual layers is within the range of 5-50 μm, preferably in the range of 5-30 μm, and wherein the total thickness of the laminated multi-layer is in the range of 20-150 μm.

The use of this multi-layer is described earlier in relation to the associated method step(s). Optionally, a top seal film can be provided to cover the food receiving or carrying compartment of the packaging unit, as was also mentioned in relation to the associated method step.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION OF THE PREFERRED EMBODIMENTS

Figure 1:
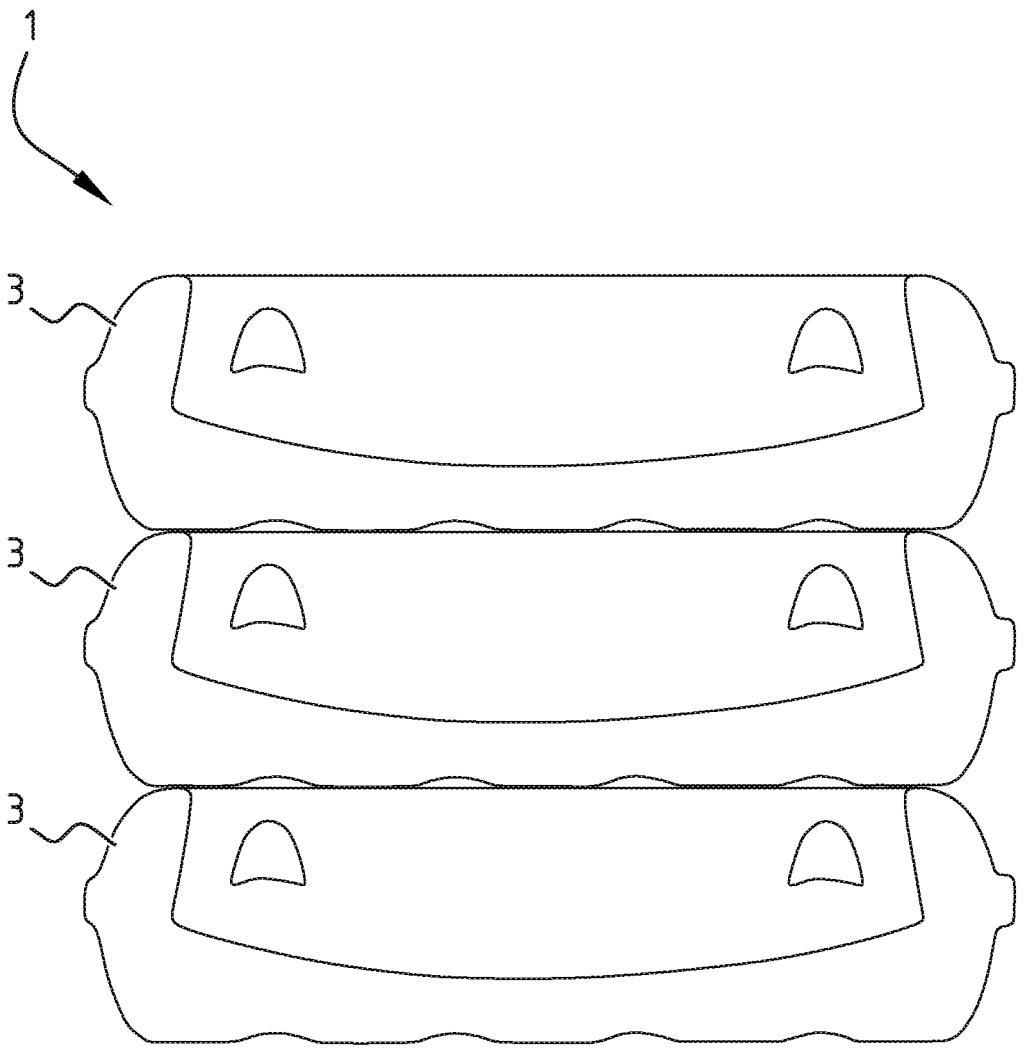
FIG. 1 shows a stack of packaging units.

Stack 1 (FIG. 1) comprises a number of stacked egg packaging units 3. To enable a stable stack packaging units 3 must be able to carry the upper units 3.

Figure 2:
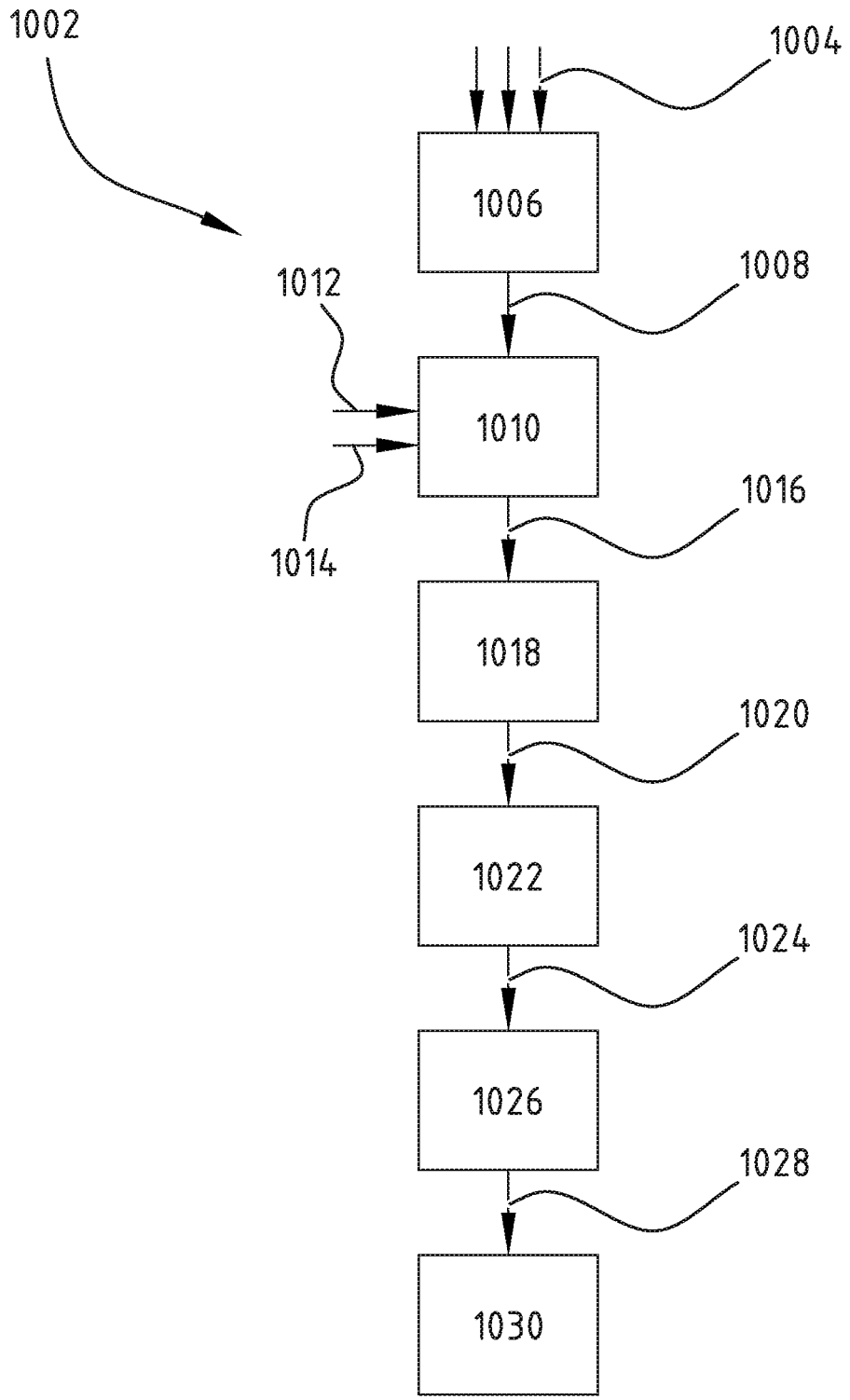
FIG. 2 shows a schematic overview of the method according to the invention.

To produce units 3 with sufficient strength, method 1002 (FIG. 2) starts by providing the required raw materials 1004, such as hard wood fiber material and/or soft wood fiber material and/or non-wood fiber material. The raw material 1004 is prepared in step 1006 to achieve raw moulded pulp material 1008. Optionally, one or more pretreatments steps are performed.

Pretreatment may involve one or more of mixing, kneeding, shreddering and/or other suitable pretreatments. Raw moulded pulp material 1008 is extruded in extrusion step 1010. In the illustrated embodiment during extrusion step 1010 additional materials are added, such as fixative(s) 1012 and pigment(s) 1014. Optionally, other additives are added during extrusion step 1010 and/or during preparation step 1006. After extrusion 1010, moulded pulp material 1016 is provided to the manufacturing step 1018 to manufacture moulded packaging units 1020 that are dried in drying step 1022. Packaging units 1024 are stored/transported/displayed in handling step 1026. Used packaging units 1028 are degraded/composted/recycled in final or recycling step 1030.

Next, some examples of packaging units that are manufactured from moulded pulp using method 1002 are shown.

Packaging unit 2 (FIG. 3A) relates to a food receiving container having bottom part 4 and side walls 6 defining opening 8. In the illustrated embodiment, on the inside of container 2 there is provided laminated multi-layer 10 comprising a compostable vinyl alcohol polymer. In the illustrated embodiment layer 10 comprises print 12. Preferably, in the illustrated embodiment the print is provided on the back side of laminated multi-layer 10.

Figure 3A:
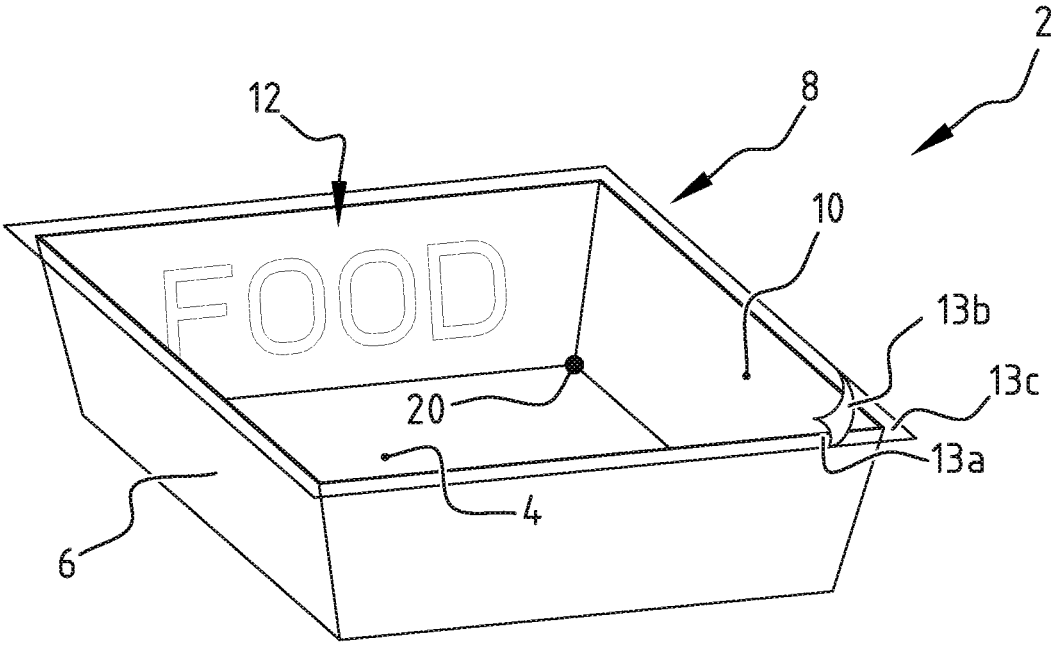
FIGS. 3A and 3B show a packaging unit according to the present invention

In the illustrated embodiment container 2 is provided with peelable top seal film 13*a* (FIG. 3A). Edge 13*b* of film 13*a* is shown as peeled from edge 13*c* of container 2. In this embodiment top seal film 13*a* is shown as transparent film. It will be understood that film 13*a* can also be provided as non-transparent, or alternatively as semi-transparent and/or partly transparent. Alternatively container 2 can also be provided without top seal film 13*a*.

Figure 3B:
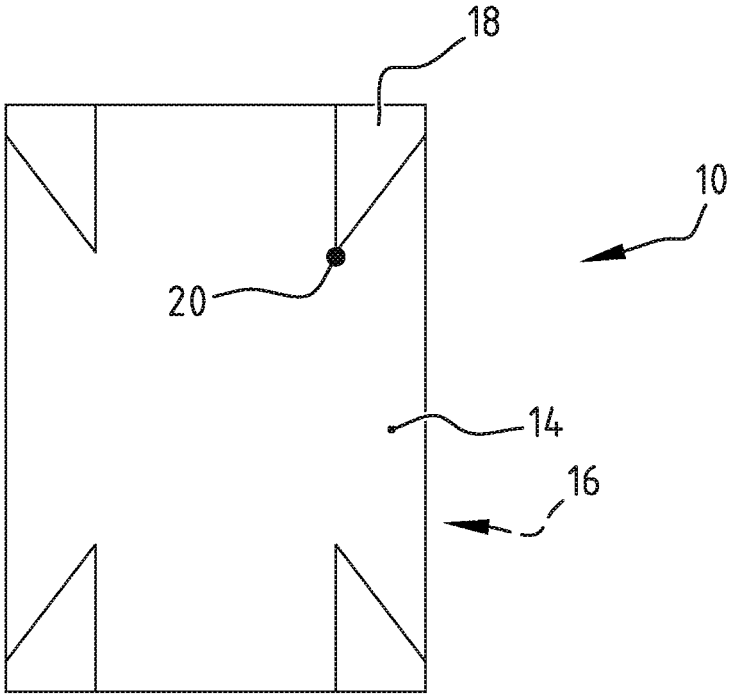

In the illustrated embodiment, laminated multi-layer 10 (FIG. 3B) comprises a food oriented side 14 and a packaging side 16. In the illustrated embodiment parts 18 can be removed or cut from sheet or layer 10 to dimension laminated multi-layer 10 according to the specifications and enable providing layer 10 into the inside of container 2. This enables positioning laminated multi-layer 10 correctly relative to corners 20. In this illustrated embodiment print 12 is provided in a mirror image on package side 16 of laminated multi-layer 10 to render the render print 12 visible for a user or consumer.

Figure 3C:
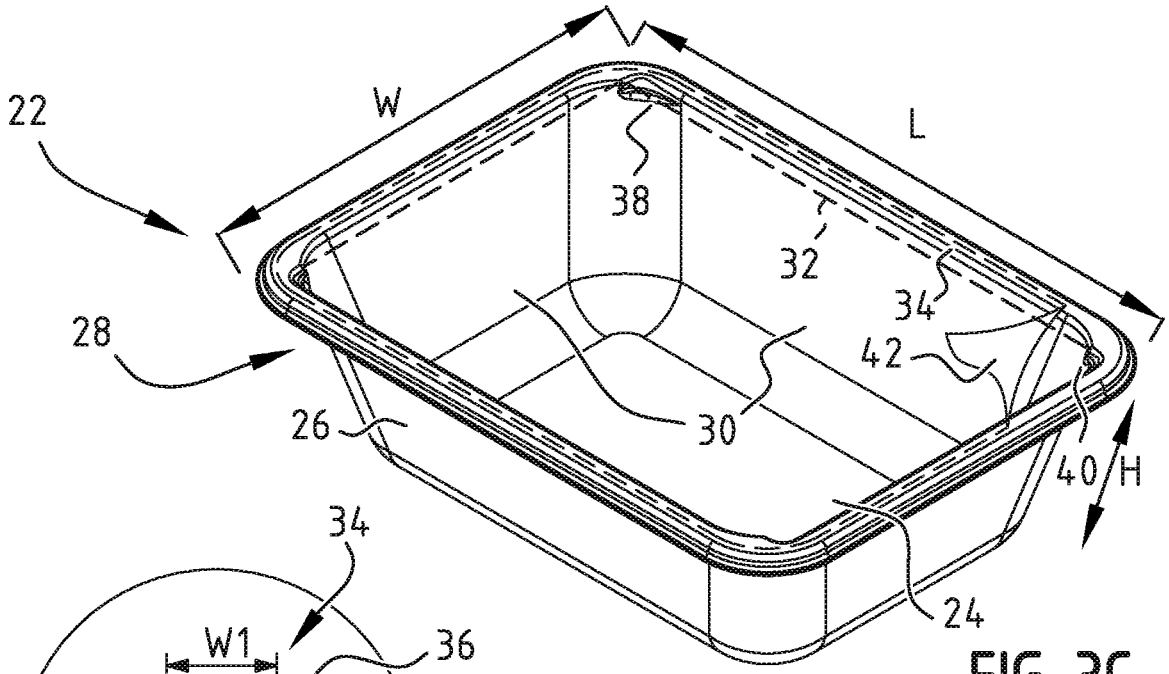
FIGS. 3C and 3D show an alternative packaging unit according to the invention.
Figure 3D:
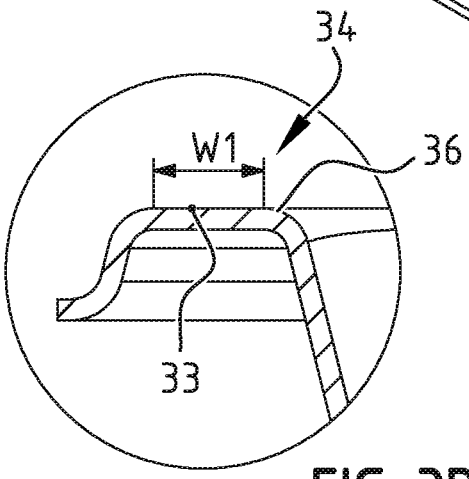

Packaging unit 22 (FIG. 3C) provides a further embodiment of a food receiving container having bottom part 24 and side walls 26 defining opening 28. Packaging unit 22 has length L, width W and height H. On the inside of container 22 there is provided laminated multi-layer 30, optionally comprising a print. In the illustrated embodiment laminated multi-layer 30 is provided on the inside of packaging unit 22 and extends from bottom part 24 up to contour or edge 32. Contour or edge 32 is provided a small distance from the upper side of edge 34. This distance is preferably in the range of 1 to 12 mm. Edge 34 (FIG. 3D) is provided with width W1 that defines contact surface 36 for connecting to liner or seal 33 that is schematically illustrated. In the illustrated embodiment this liner or seal 33 is connected directly to the moulded pulp material, optionally with an adhesive, in stead of being connected to laminated multi-layer 30. Such adhesive preferably comprises an amount of biodegradable polyester, for example PBS. Width W1 is in the illustrated embodiment in the range of 1 to 15 mm, preferably in the range of 2 to 5 mm.

Packaging unit 22 (FIG. 3C) comprises first denesting elements 38 and second denesting elements 40. In the illustrated embodiment, optional top seal film 42 is provided.

Figure 3E:
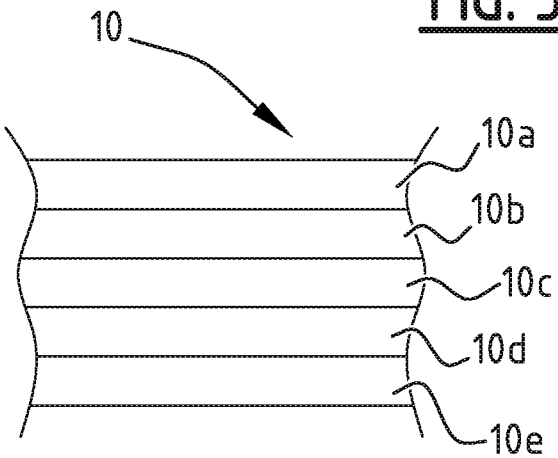
FIG. 3E shows a detail of the laminated multi-layer.

Laminated multi-layer 10 (FIG. 3E) comprises first cover layer 10*a*, first intermediate layer 10*b*, central functional layer 10*c*, second intermediate layer 10*d*, and second cover layer 10*e*. It will be understood that other layers can be added to multi-layer 10. It will be understood that laminated multi-layer 10 can be applied to container 2, and also to packaging unit 22 and more specifically the food contact surfaces of bottom part 24 and side walls 26 thereof.

Figure 4:
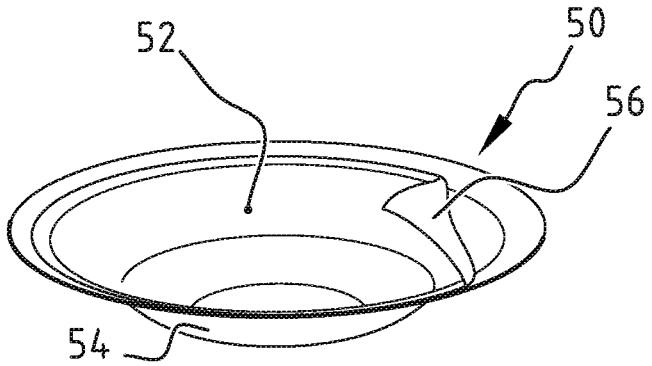
FIG. 4 shows a plate as food receiving product according to the invention.

In another embodiment, plate 50 (FIG. 4) is on the food receiving side provided with laminated multi-layer 52. In the illustrated embodiment bottom or back side 54 of plate 50 is not provided with such laminated multi-layer. Optionally, plate 50 is provided with top seal film 56, for example in case of plate 50 holding a salad or soup. It will be understood that also other food products can be held by plate 50. Multi-layer 52 is preferably similar to multi-layer 10 that was already illustrated.

Figure 5A:
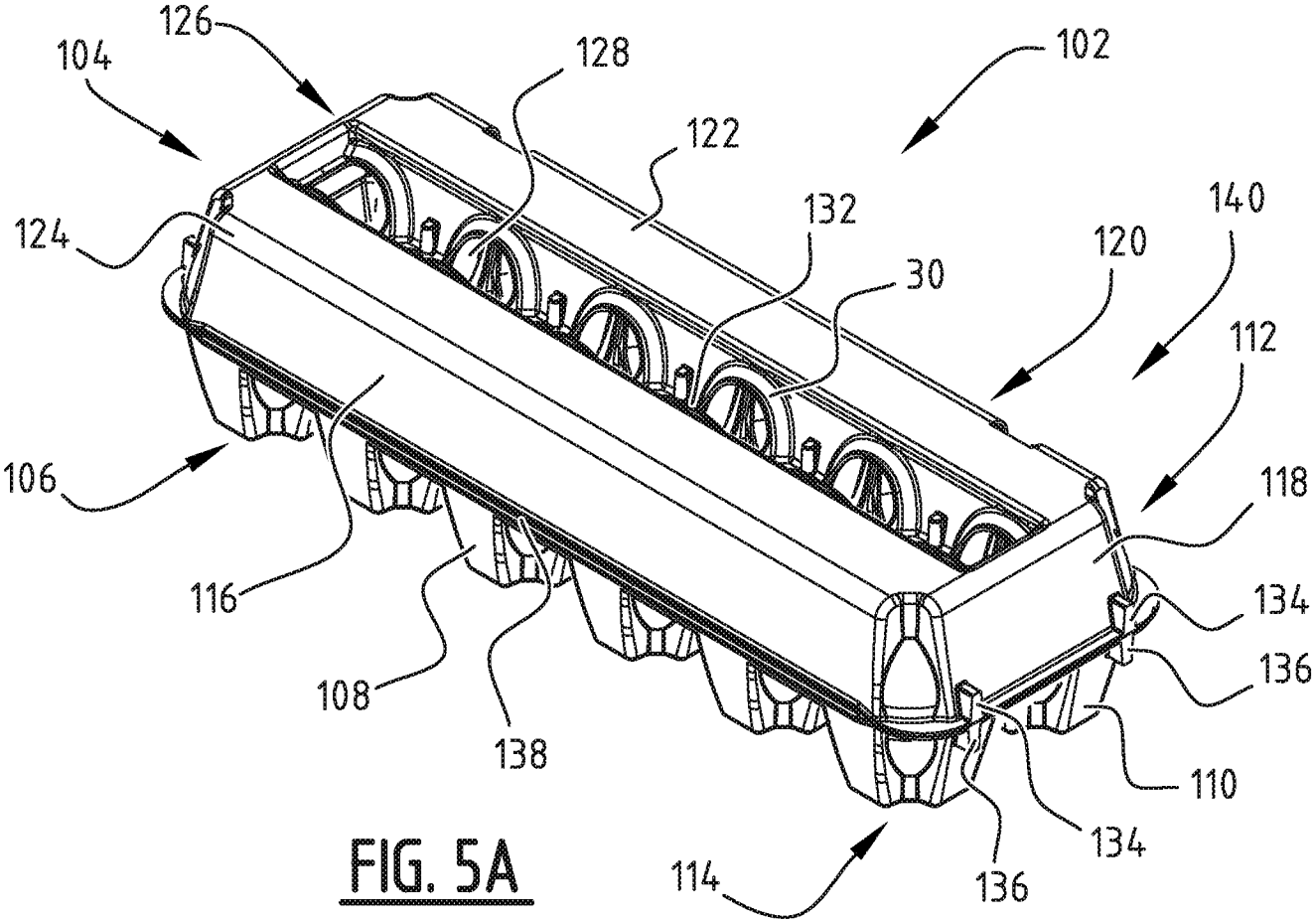
FIGS. 5A and 5B shows a packaging unit according to the invention comprising PBS and/or another biodegradable aliphatic polyester.
Figure 5B:
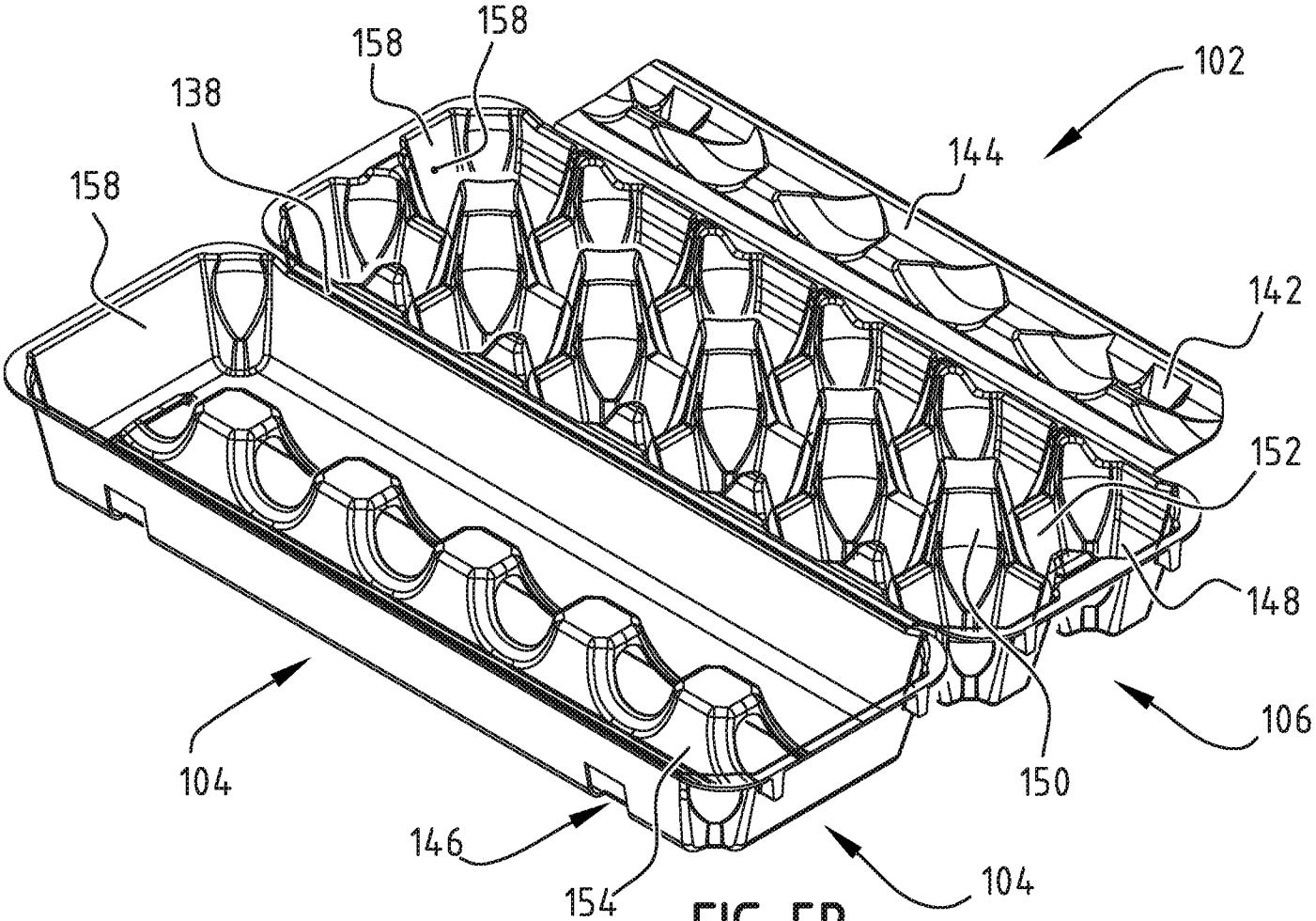

Packaging unit 102 (FIGS. 5A and B) carries or holds eggs and comprises cover part 104 and bottom part 106. Bottom part 106 is provided with back surface 108, sides 110 and front surface 112, and bottom surface 114. Cover part 104 is provided with back surface 116, side surfaces 118, front surface 120 and top surface 122. In the illustrated embodiment transition 124 is provided between top surface 122 and back and front surfaces 116, 120.

In the illustrated embodiment, top surface 122 of cover part 104 is provided with groove 126 comprising a number of openings 128. Openings 128 are defined by two adjacent arch-shaped edges 130, 132 having a larger thickness as compared to the average thickness of cover part 104. Side surfaces 118 of cover part 104 are provided with denest nocks or denest elements 134. In the illustrated embodiment, bottom part 106 is provided with similar elements 136 mirroring denest elements 134. Hinge 138 connects back surface 116 of cover part 104 with back surface 108 of bottom part 106. Lock 140 comprises nose-shaped lock element 142 that is connected to flap 144 of bottom part 106. Cover part 104 is provided with openings 146 that capture lock elements 142 therewith defining lock 140.

In the illustrated embodiment, bottom part 106 is provided with a number of product receiving compartments 148, cones 150 and separating walls 152. Cone 150 extends from the bottom of bottom part 106 in an upward direction. Cover part 104 comprises cone support 154. Inner surface 158 of packaging unit 102 may comprise PBS and/or other suitable biopolymer material, optionally as film layer or alternatively blended and/or integrated with the fibers of the moulded pulp material. Packaging unit 102 may also be configured to receive other products, such as tomatoes, kiwis.

Figure 6A:
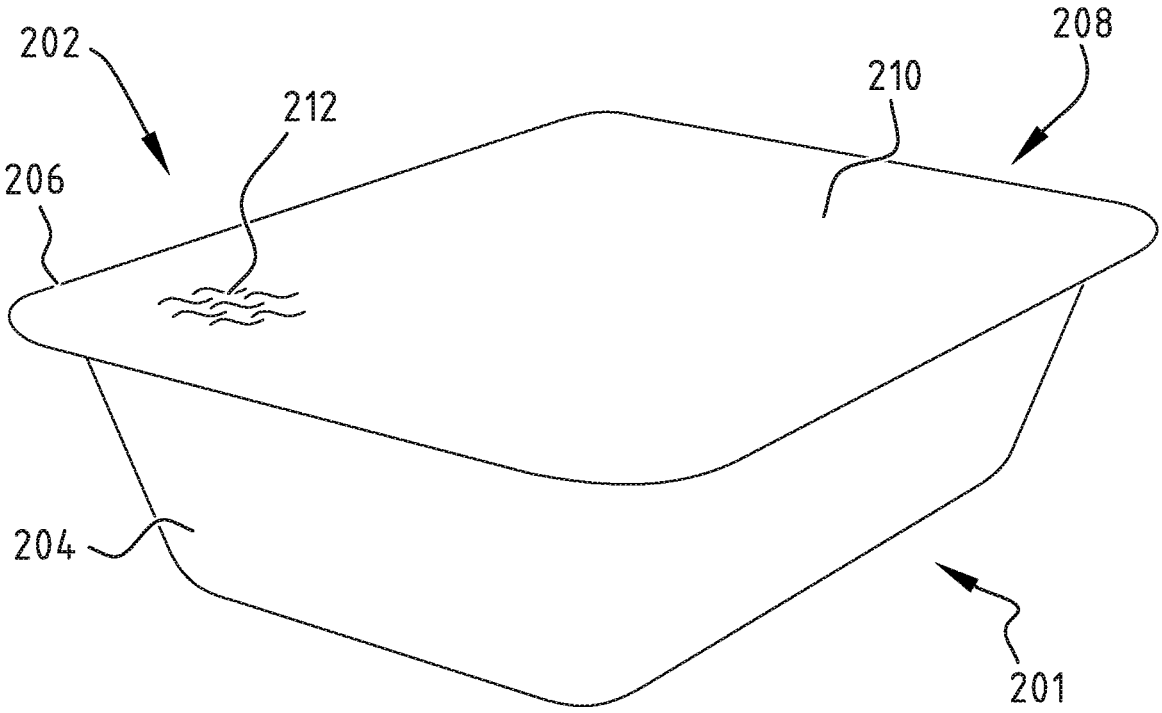
FIGS. 6A and 6B shows an alternative food packaging product and a meat dish according to the invention.

Packaging unit 202 (FIG. 6A) comprises laminated multi-layer 201 that is provided on bottom part 204 and cover part 206. Multi-layer 201 is preferably similar to multi-layer 10 that was already illustrated. Unit 202 is provided with biodegradable aliphatic polyester, such as PBS, and is capable of holding an amount of ice cream. Cover part 206 comprises top seal 208 of a layer or film 210 of biodegradable aliphatic polyester(s), wherein optionally a (paper) label is provided. Optionally, fibers 212 are included in the cover part 206. This improves the possibilities for giving the unit a natural paper feel and/or look. This may also be applied to other type of packaging units. For example, in instant or ready-to-eat meals, such conventional sleeves can be omitted from the packaging units. This enables a more cost-efficient packaging unit with a possible weight reduction.

Packaging unit 202 has numerous applications, including but not limited to, airplane meals. Such meals are provided to the airplane after (dry) sterilisation and pasteurisation. In combination with the ($O_2$)-barrier properties of the laminated multi-layer (and top seal film) the shelf-life of the food product is significantly improved. In addition, the $O_2$-barrier prevents or at least reduces oxidation processes in the food and thereby contributes to the maintenance of food taste.

Figure 6B:
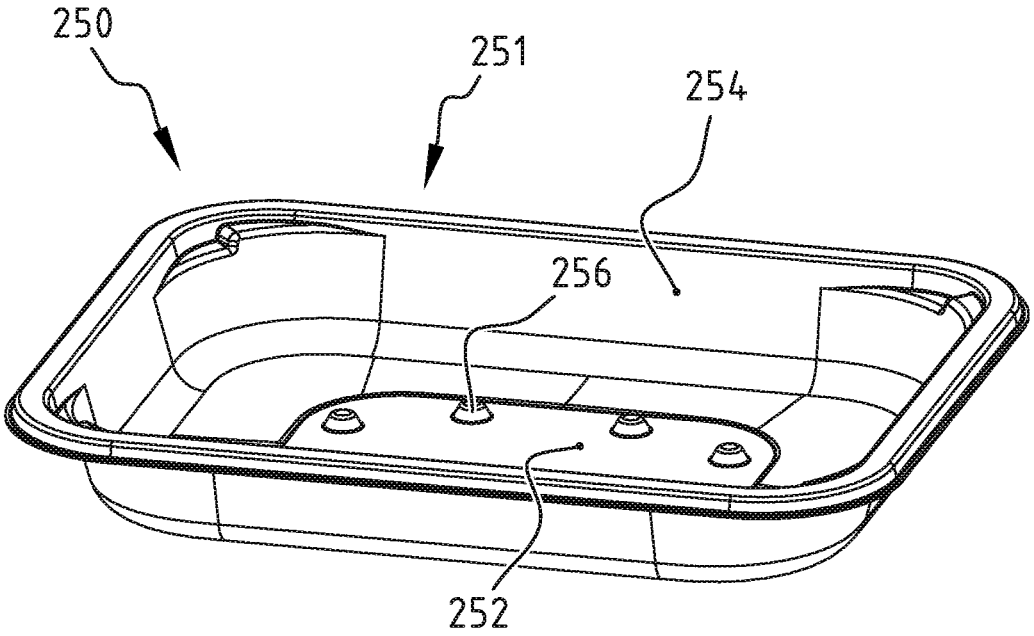

Meat dish 250 (FIG. 6B) is provided from an extruded moulded pulp that is preferably provided with a pigment and a fixative. Dish 250 comprises bottom 252 and side wall 254. In the illustrated embodiment bottom 252 comprises a number of protrusions 256. It will be understood that protrusions 256 are optional. Also, the shape of protrusions may be chosen differently. Also optional, laminated multi-layer 251 is provided. Not shown is a seal or top film that covers dish 250.

Figure 7:
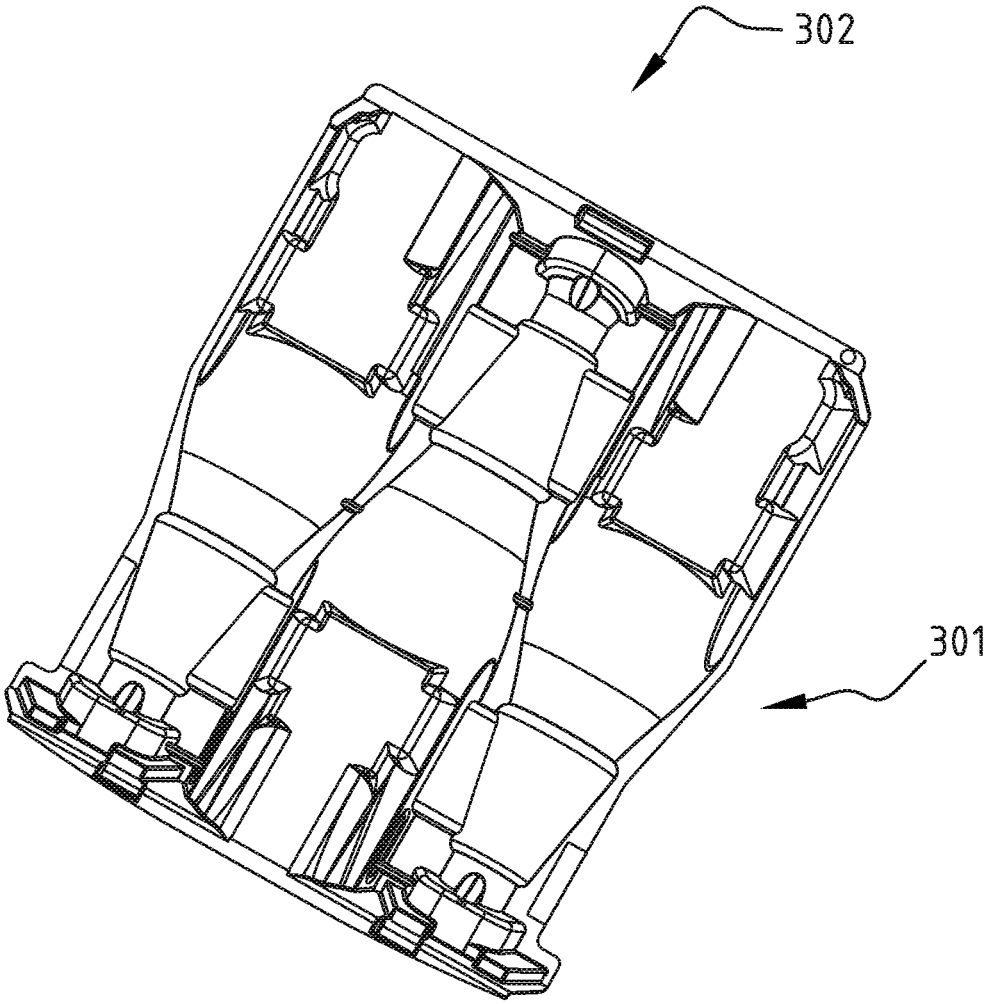
FIG. 7 shows a bottle divider according to the present invention.

As a further example, bottle divider 302 (FIG. 7) is illustrated with optionally laminated multi-layer 301. Multi-layer 301 is preferably similar to multi-layer 10 that was already illustrated. Also, bottle divider 102 may comprise an additional film layer of PBS (and/or appropriate alternative biodegradable aliphatic polyester) and/or may comprise an amount of PBS that is blended into the moulded pulp.

Figure 8A:
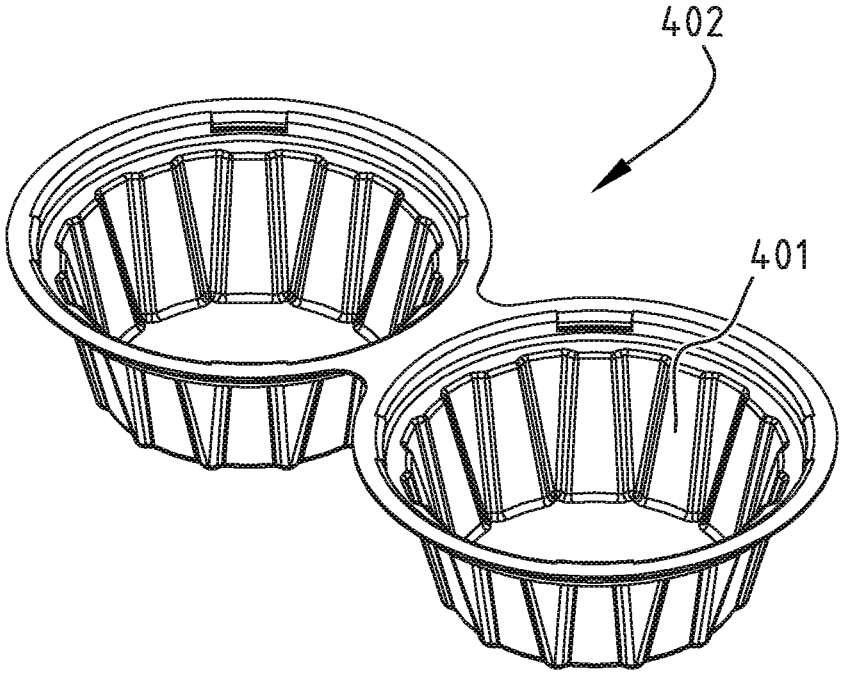
FIGS. 8A and 8B show further packaging units according to the invention.
Figure 8B:
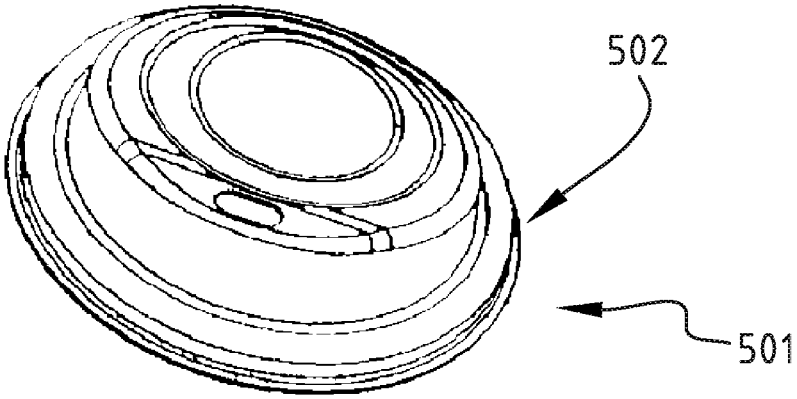

A further example in accordance with the present invention is cover 402, for example for an ice cup (FIG. 8A) that is provided with laminated multi-layer 401. Another example of a packaging unit according to the invention is sip lid 502 (FIG. 8B) that is provided with laminated multi-layer 501. Multi-layers 401, 501 are preferably similar to multi-layer 10 that was already illustrated. Cover 402 and sip lid 502 comprise an additional film layer of biodegradable aliphatic polyester and/or may comprise an amount of biodegradable aliphatic polyester that is blended into the moulded pulp. This renders cover 402 and sip lid 502 water or liquid repellent and/or improves the heating step to melt or fuse laminated multi-layer 401, 501 on or to cover 402 and/or sip lid 502. It will be understood that such lids 502 can also be applied to other food containers. For example, lids 502 can be applied to containers for milkshakes, for example. Further details and examples of lids 502 are disclosed in WO 2010/064899, including embodiments with specific flanges and notches. Also, sip lids can be applied to so-called ready meal trays (for example for pizza, wraps, fish, meat, lobster, pasta, . . . ) and act as a (digital) printable and barrier seal, for example.

Figure 9A:
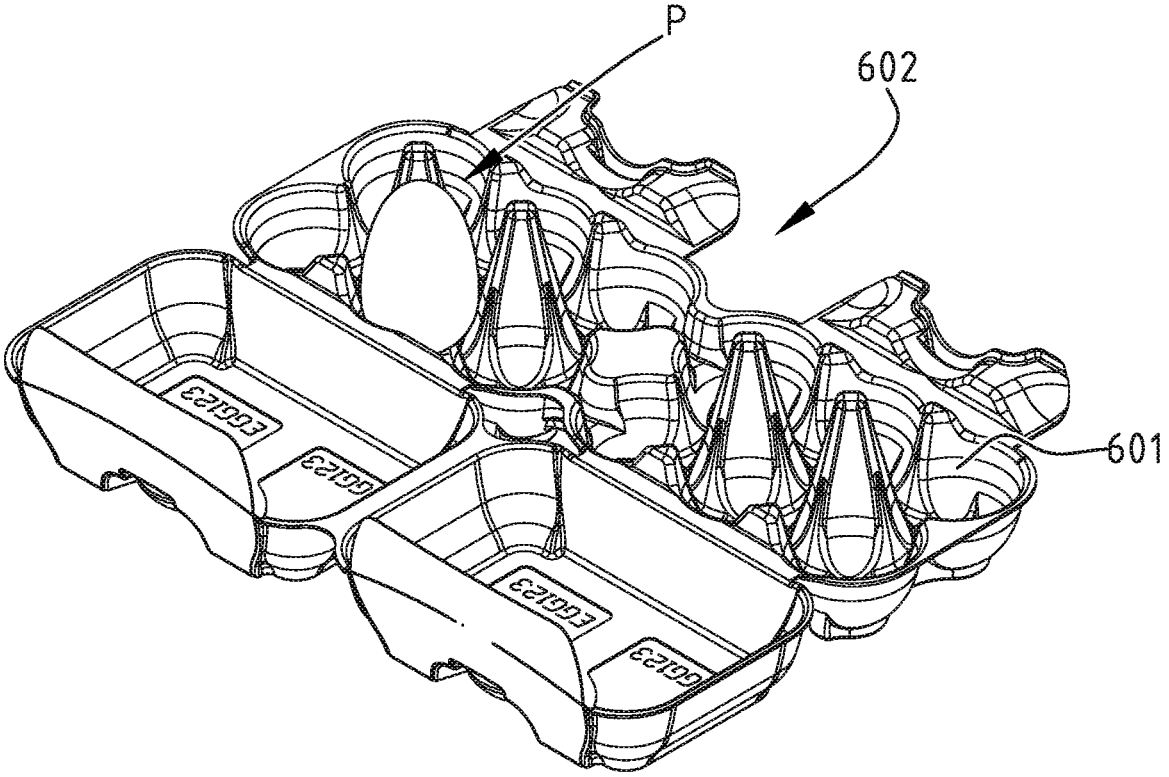
FIGS. 9A and 9B show a packaging unit for eggs according to the invention.
Figure 9B:
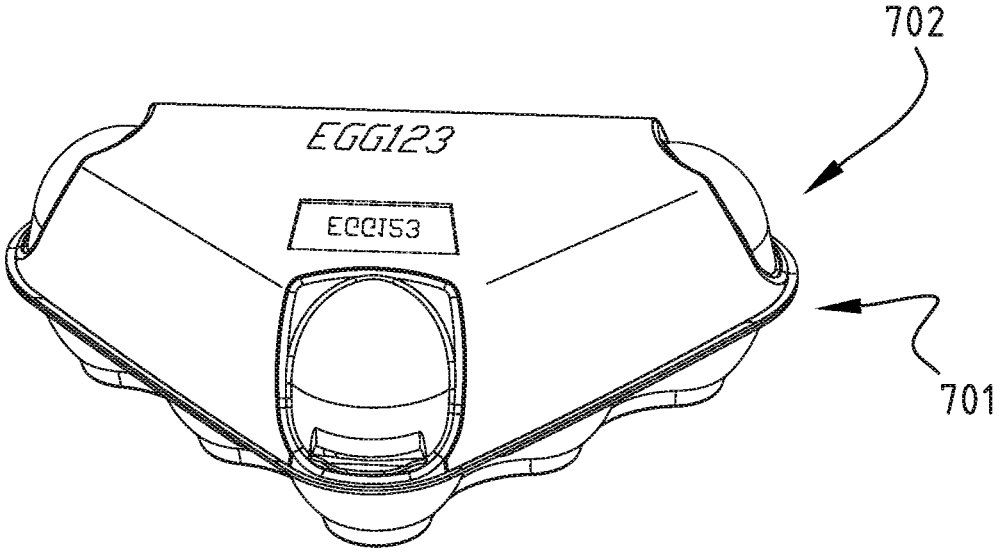
Figure 10:
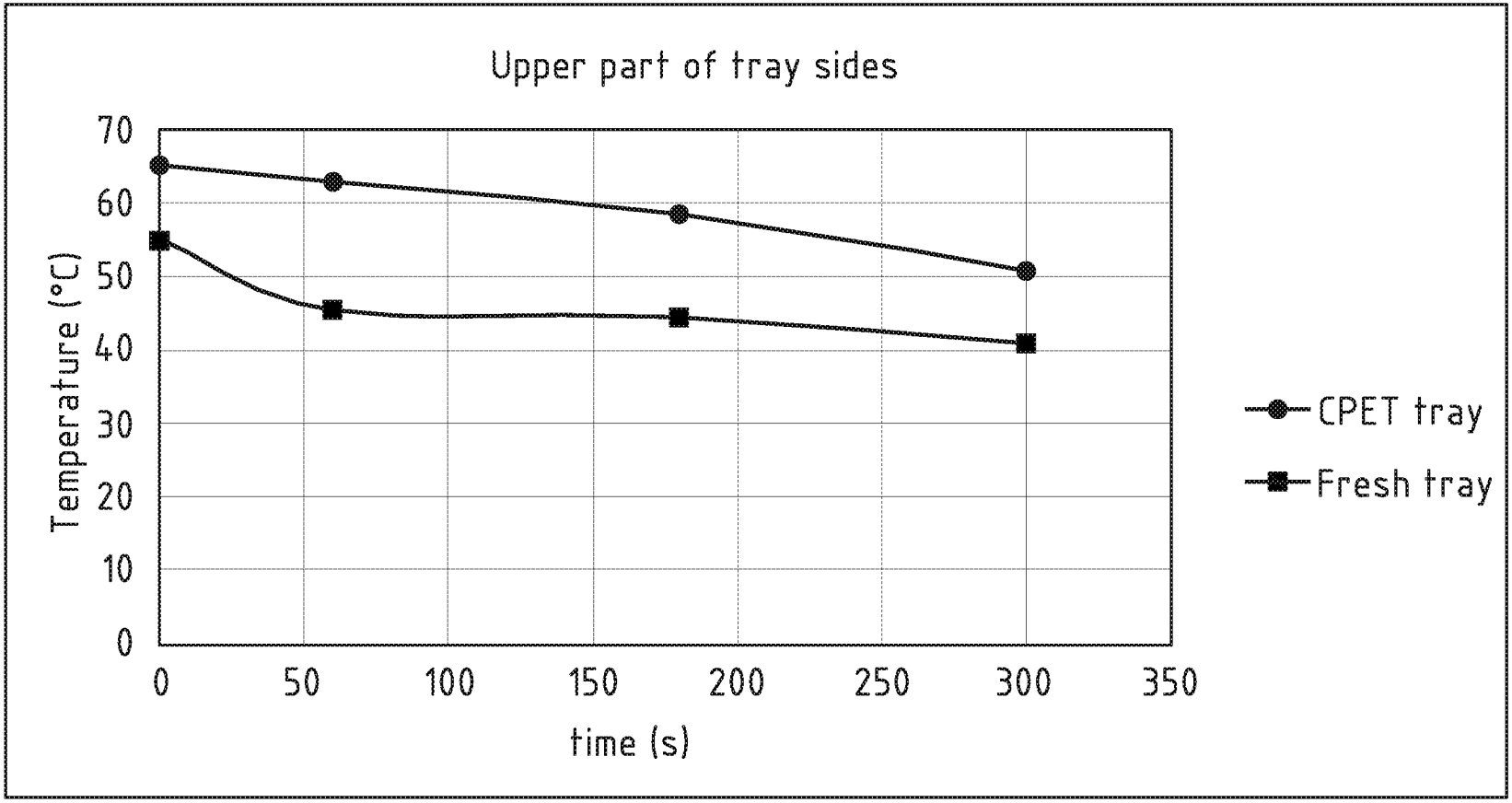
FIG. 10 shows experimental results with conventional packaging units and packaging units according to the present invention.

It will be understood that other designs for packaging units in accordance with the invention can be envisaged. For example, containers 602, 702 (FIGS. 9A and B) illustrate different designs for egg cartons capable of holding eggs P and comprise laminated multi-layer 601, 701. Multi-layers 601, 701 are preferably similar to multi-layer 10 that was already illustrated.

Other examples of food packaging products may relate to cup carriers, cups, plates and other table ware etc.

When manufacturing a food packaging unit 2, 3, 50, 102, 202, 252, 302, 402, 502, 602 a moulded pulp material is prepared. Optionally, an amount of biodegradable aliphatic polyester, such as PBS and/or PHBH, is blended or mixed into the moulded pulp material and/or an amount of biodegradable aliphatic polyester, such as PBS and/or PHBH is included in a separate layer that is provided in or on unit 2, 3, 50, 102, 202, 252, 302, 402, 502, 602. Such separate layer may improve the contact with laminated multi-layer 10, 52, 101, 201, 251, 301, 401, 501, 601 optionally comprising a vinyl alcohol polymer, such as HAVOH and/or BVOH. Preferably, laminated multi-layer is co-extruded with the moulded pulp material and deep-drawn. In addition, or as an alternative, the raw unit is moulded. Optionally, the raw unit is dried in the mould applying an in-mould drying process. In such alternative embodiment laminated multi-layer 10, 52, 101, 201, 251, 301, 401, 501, 601 is provided in the mould and a heating step is performed. Optionally, an additional layer of biodegradable aliphatic polyester is provided to improve the contact between the packaging unit and the laminated multi-layer. Finally the product is released from the mould.

Several post-drawing or post-moulding operations may optionally be performed in relation to unit 2, 3, 50, 102, 202, 252, 302, 402, 502, 602 optionally including, but not limited to, labelling including in-mould labelling, marking including printing and digital printing, testing. Experiments have been performed with one or more of the illustrated food packaging units that were manufactured from a moulded pulp that was provided involving an extrusion process.

In a first test a hardwood-softwood cellulose pulp mixture was used, using e.g. about 60% softwood cellulose pulp (spruce, pine), combined with about 40% hardwood cellulose pulp (like birch), both for the Twin Screw extrusion and the standard pulped and refined pulp. In the experiments a peristaltic pump was used. From the pulp hand sheets were made in both cases, and also 3-dimensional in-mould dried products.

| | Tensile index (Nm/g) | E modulus (MPa) | Taber stiffness (mN) | Shopper Riegler (SR) |
|---|---|---|---|---|
| Standard: | 20-40 | 400-1000 | 1000-1200 | 20-40 |
| Extrusion: | 20-43 | 400-950 | 1000-1250 | 25-45 |

Standard involved standard pulping follow by a disc refining process. The applied refining energy was 40-80 kWh/t.

Extrusion involved so-called twin screw extrusion.

From these hand sheet mechanical strength and freeness (SR relating to pulp freeness, dewatering) observations it can be concluded that the Twin Screw Extrusion can achieve a similar or slightly better result as when using a standard paper making set up using a pulper and disc refiner. The Twin Screw technology could therefore replace a pulper and refiner. Another observation during the tests was that the fibrillation of the fibers is better, i.e. leaving more open positions on the fibers to bind cationic additives like AKD sizing. Also the average fiber length of the extrusion process leads to a fiber length that is approximately 60% larger as when the same pulp/fibers are used in a conventional pulping and refining process. This may obviate the need for a conventional pulper and refiner combination. These larger fibers enhance the dewatering of a fiber slurry in a paper making process or in a moulded fiber process, both for an in-mould drying molded fiber process, where the paper slurry after the $1^{st}$ forming step under vacuum is formed followed by one or more drying steps in a heated mould, and also in a conventional moulded fiber process where the paper slurry after the $1^{st}$ forming step under vacuum is formed and then dried in a conventional drying process (like a gas heated and/or electrical heated drying oven).

Results of an in-mould drying process of a 3-dimensional packaging unit, using moulded pulp disclosed/refined in a Twin screw extrusion process show that the dryness of the pulp in the first forming step is 25-35%, where at the same machine with conventional refined pulp a dryness is achieved between 20-25% at low temperatures (ambient temperature). At higher process water temperatures the difference in dryness is slightly higher (2-3%), but remains in the same band width between the two refining technologies. This higher dryness leads to a faster machine speed to produce products. Also it saves energy to dry the products. Another observation of in-mould dried products that were refined in a Twin Screw Extruder system compared to conventional pulped and refined pulp is that the strength and stiffness of the in-mould dried products made out of the pulp is 40-70% better. For example, the Taber Stiffness was in the range of 40-80% higher and also the compression strength of a 3D molded product is 40-80% higher.

The experiment showed that this way of refining a hardwood-softwood mixture in an extrusion process is therefore also enabling IMD moulded pulp product producers to make lighter weight products with remaining the same stiffness and strength properties leading also to lower drying energy levels, a better carbon footprint for the products. Depending on the application of the moulded pulp product in the market (like a meat tray used in a skin packaging where the tray needs to be very strong to avoid collapsing or warpage of the tray) this technology can also lead to stronger products, stiffer products.

Another observation from the experiments is that due to a different way of refining the fibers, leading to different fibrillation and creating more open spaces on the fibers, anionic charged, to bind cationic charged molecules like an AKD sizing or other cationic charged molecules like dyes or fixatives to bind pigments. To illustrate that effect: Twin screw refined pulp adding 2% AKD sizing, as received from suppliers (with ca 15% effective alkyl ketene dimer) lead to a Cobb (60 sec) of 10-20 g/m$^2$, where the same pulp refined in the conventional way leads with same AKD sizing to a Cobb (60 sec) of 20-45 g/m$^2$. It was shown that pigments could bind more easy to the fibers in the extrusion process. Furthermore, it was established that the process water in the extrusion process was less polluted with pigments as compared to conventionally adding pigments.

Other tests were performed to show the dual ovenable (oven and microwave) performance of the packaging unit according to the invention. In the experiments the laminated product was heated to a temperature of about 190° C. for about 30 minutes. Results show that the film layer remains intact and does not melt. No leakage was detected. Furthermore, the strength and stability of the packaging unit were not significantly affected. As a further effect, the packaging unit was more stable in view of twisting when removing the packaging unit from the oven as is often the case with conventional packaging units. Furthermore, the packaging unit of the invention showed a limited temperature increase to about 50-70° C., while the conventional units reached a temperature of about 90-100° C. under similar conditions. Other experiments with a (food) tray shows an even improved heat resistance when heating the tray to a temperature of 180-200° C., and in addition shows (an improved) oil, acid and moisture resistance/repellence.

Other tests were performed to show the performance of the packaging unit according to the invention by heating the packaging unit in an oven and/or microwave. In the experiments the laminated product, comprising a laminated layer with a total thickness of about 40 μm, was heated to a temperature of about 180° C. for about 35 minutes. Results show that the film layer remains intact and does not melt. No leakage was detected. Furthermore, the strength and stability of the packaging unit were not significantly affected. As a further effect, the packaging unit was more stable in view of twisting when removing the packaging unit from the oven as is often the case with conventional packaging units. Leaking of the film layer was tested by using food simulantia such as 95% ethanol, modified polyphenylene oxide (MPPO), 2,2,4-trimethylpentane, and the like. Thus, this test showed a safe use of the laminate product as packaging, for example food packaging.

The present invention is by no means limited to the above described preferred embodiments thereof. The rights sought are defined by the following claims, within the scope of which many modifications can be envisaged. It is noted that this invention is not limited for cellulose fibers and not limited for smooth molded fiber processes but works for any biomass/fiber/alternative fiber material, also in the rough molded fiber process. Also, this invention is not limited to 3D moulded fiber production and can also be applied to the flat paper production in paper mills facing similar challenges with coloured water treatment.

The invention claimed is:

1. A method for producing a moulded pulp material for a packaging unit, the method comprising the steps of:

preparing a raw pulp material;
wettening a raw pulp material in a tank;
providing the raw pulp material to an extruder;
anionically charging the raw pulp material;
adding one or more additives;
extruding the raw pulp material; and
providing the moulded pulp material at the outlet of the extruder,
wherein adding one or more additives comprises adding a cationic fixative followed by a biodegradable anionic pigment to the raw pulp material,
wherein a weight ratio of pigment to fixative is in the range of 2-25, and
wherein extruding the raw pulp material comprises:
reacting the fixative with cellulose fibers of the raw pulp material; and
attaching the pigment to the cellulose fibers of the raw pulp material.

2. The method according to claim 1, further comprising the step of selecting one or more dimethylamine polymers as fixative.

3. The method according to claim 1, wherein a weight ratio of additive to fixative is in the range of 4-19.

4. The method according to claim 1, wherein the raw moulded pulp material comprises a mixture of soft wood and hard wood, and/or comprising the step of providing an amount of natural fibers.

5. The method according to claim 1, further comprising the step of adding an amount of a biodegradable aliphatic polyester, wherein the amount of biodegradable aliphatic polyester in the moulded pulp material is in the range of 0.5-20 wt. %, wherein the biodegradable aliphatic polyester comprises at least an amount of polybutylene succinate (PBS), polyhydroxybutyrate (PHB), polyhydroxyalkanoate (PHA), polycaprolactone (PCL), polyglycolic acid (PGA), poly(3-hydroxybutyrate-co-3-hydroxyhexanoate) (PHBH), or Poly(3-hydroxybutyrate-co-3-hydroxyvalerate) (PHBV).

6. The method according to claim 1, further comprising:
providing a laminated multi-layer to the extruder;
extruding the laminated multi-layer with the raw pulp material; and
deep-drawing the extruded laminated multi-layer and raw pulp material into a packaging unit,
wherein the laminated multi-layer comprises:
an inner cover layer comprising an amount of a biodegradable aliphatic polyester;
a first intermediate layer of a biodegradable material for connecting and/or sealing adjacent layers;
a functional layer comprising a vinyl alcohol polymer;
a second intermediate layer of a biodegradable material for connecting and/or sealing adjacent layers; and
an outer cover layer comprising an amount of a biodegradable aliphatic polyester,
wherein the laminated multi-layer renders the food packaging unit as a compostable packaging unit.

7. The method according to claim 6, further comprising the step of providing a biodegradable top seal film.

8. A packaging unit from a moulded pulp material, the packaging unit comprising a food receiving and/or carrying compartment, wherein the moulded pulp material is provided by a method according to claim 1.

9. The packaging unit according to claim 8, wherein the moulded pulp material comprises an amount of fibers, wherein at least 80% of the fibers has a length above 1.1 mm.

10. The packaging unit according to claim 8, wherein the fixative comprise dimethylamine polymers.

11. The packaging unit according to claim 8, further comprising a biodegradable laminated multi-layer, with the multi-layer comprising:
an inner cover layer comprising an amount of a biodegradable aliphatic polyester;
a first intermediate layer of a biodegradable material for connecting and/or sealing adjacent layers;
a functional layer comprising a vinyl alcohol polymer;
a second intermediate layer of a biodegradable material for connecting and/or sealing adjacent layers; and
an outer cover layer comprising an amount of a biodegradable aliphatic polyester, and
wherein the packaging unit is a compostable packaging unit,
wherein the thickness of the individual layers is within the range of 5-50 μm, and
wherein the total thickness of the laminated multi-layer is in the range of 20-150 μm.

12. The packaging unit according to claim 11, wherein the laminated multi-layer is a co-extruded laminated multi-layer,
wherein the laminated multi-layer is melted or fused with the compartment,
wherein the packaging unit comprises a layer of biodegradable aliphatic polyester on a product contact surface to improve melting or fusing of the laminated multi-layer thereon,
wherein the laminated multi-layer is melted in a moulded pulp material matrix.

13. The packaging unit according to claim 11, further comprising a biodegradable top seal film,
wherein the packaging unit comprises a circumferential edge comprising a connecting surface for the top seal film that is substantially free of the laminated multi-layer, and
wherein the top seal film comprising a biodegradable aliphatic polyester.

14. A method for producing a moulded pulp material for a packaging unit, the method comprising the steps of:
preparing a raw pulp material;
wettening a raw pulp material in a tank;
providing the raw pulp material to an extruder;
anionically charging the raw pulp material;
adding one or more additives;
extruding the raw pulp material; and
providing the moulded pulp material at the outlet of the extruder,
wherein the additives comprise a biodegradable anionic pigment, wherein the biodegradable anionic pigment is added after adding a fixative, wherein the fixative is a cationic fixative, and wherein the weight ratio of pigment to fixative is in the range of 2-25, and
wherein extruding the raw pulp material comprises:
reacting the fixative with cellulose fibers of the raw pulp material; and
attaching the biodegradable anionic pigment to the cellulose fibers of the raw pulp material.

15. The method according to claim 14, further comprising the step of adding an amount of a biodegradable aliphatic polyester, wherein the amount of biodegradable aliphatic polyester in the moulded pulp material is in the range of 0.5-20 wt. %.

* * * * *